United States Patent [19]

Bruce

[11] Patent Number: 4,632,088

[45] Date of Patent: Dec. 30, 1986

[54] BALL THROWING APPARATUS

[76] Inventor: Norman R. Bruce, 5055 Dobrot Way, Central Point, Oreg. 97502

[21] Appl. No.: 470,430

[22] Filed: Feb. 28, 1983

[51] Int. Cl.[4] ..... F41B 15/00

[52] U.S. Cl. ..... 124/78; 124/6; 273/26 D

[58] Field of Search ..... 124/78, 83, 41 R, 81, 124/6; 273/26 D, 55 R

[56] References Cited

U.S. PATENT DOCUMENTS

| | | | |
|---|---|---|---|
| Re. 28,462 | 7/1975 | Halstead | 124/1 |
| 2,112,611 | 3/1938 | Snippen | 124/78 |
| 2,737,941 | 3/1956 | Carrau | 124/78 |
| 3,459,168 | 8/1969 | Bruce | 124/11 |
| 3,538,900 | 11/1970 | Samuels | 124/78 |
| 3,604,409 | 9/1971 | Doeg | 124/78 |
| 3,724,437 | 4/1973 | Halstead | 273/26 D X |
| 3,766,901 | 10/1973 | Cleary et al. | 273/26 D X |
| 3,794,011 | 2/1974 | Newgarden | 124/78 |
| 4,193,591 | 3/1980 | Paulson | 273/26 D X |
| 4,323,048 | 4/1982 | Saito et al. | 124/78 |

OTHER PUBLICATIONS

"Collegiate Baseball", vol. XXIII, No. 14, Oct. 24, 1980, photocopies of the following pages are attached hereto: 13,27,35,36.

*Primary Examiner*—Richard J. Apley
*Assistant Examiner*—John L. Welsh
*Attorney, Agent, or Firm*—Warren T. Jessup

[57] ABSTRACT

A ball throwing apparatus has two opposed drive wheels, one on each side of an open-ended barrel. The peripheries of both drive wheels extend into the barrel in opposing fashion, the wheels being slightly offset so that the second periphery frictionally engages the ball before the first periphery does. This directs the ball initially on a path divergent from the barrel axis. The drive wheels are rotated at dissimilar speeds and/or the diameters of the wheels are not the same so that the peripheral speeds of the two drive wheels are different. This imparts a spin to the ball and gives it a curved flight path. The barrel is rotatably mounted to allow the barrel to be rotated about its longitudinal axis to any angular position.

The barrel mounting is attached to a tripod, and the mounting can be adjusted to alter the attitude of the barrel to change the trajectory of the ball.

18 Claims, 6 Drawing Figures

BALL THROWING APPARATUS

BACKGROUND OF THE INVENTION

Dual opposed drive wheels which frictionally engage a ball and propel it through a barrel and towards a batter is disclosed in the prior art ball throwing devices.

One machine discloses a housing enclosing a barrel for the ball, directly opposed drive wheels partially projecting inside the barrel, and drive means for rotating the wheels. Either drive wheel can have a band attached to its circumference. These bands create an uneven surface so that when the wheels grab the ball coming through the barrel, the uneven surface spins the ball about its axis and also imparts a unique trajectory to the ball as it leaves the muzzle end of the barrel. The spin imparted to the ball is important to the batter, because it tends to duplicate the types of balls normally thrown by a pitcher in a baseball game. The pitcher gives "English" to the ball by holding it in a certain way and by tossing it with a particular flick of the wrist, resulting in the commonly designated style pitches such as a curve ball, slider, drop ball, fast ball and the like. Some of these other prior art devices simply lob the ball by pneumatic means without imparting any kind of spin characteristics.

Other prior art devices have directly opposed but separated drive wheels and the ball is fed from a chute into the nip of the wheels. The circumference of the wheels are concave in shape to aid in gripping the ball since there is no barrel to contain the ball. The RPM of either wheel can be adjusted to impart a spin to the axis of the ball. The drive wheels and housing can be tilted to change the trajectory of the ball, or the curve thrown by the ball can be adjusted by radially moving the housing to the left or right in a plane parallel with the ground.

The drawbacks found in these prior art devices is that the device must be realigned each time the batter wishes a different type of pitch be thrown, and the devices must first be adjusted before the device can throw a different type of pitch. Whenever bands are attached to the circumference of the drive wheels, a random but inaccurately thrown pitch results. In order for these devices to be of optimal use in batting practice, the ball must be consistently thrown into the strike zone of the batter. In batting practice, the prior art machines must be reset to place the ball in the strike zone each time the type of pitch is changed. This is time consuming and does not duplicate real playing conditions in a game where the pitcher randomly varies the type of pitch thrown. The time delay for adjustment precludes throwing varying pitches one after the other in quick succession, as in a ball game. It is so time consuming to change pitches that usually no changes are made during a given practice, which may last two hours. One or two changes would be the maximum that would be feasible.

No prior art machine, known to applicant, nas the capacity to tail fast balls in our out, on successive pitches, if at all. This shortcoming is a serious one.

SUMMARY OF THE INVENTION

This invention relates to a ball throwing apparatus which is economical to manufacture, easy to assemble for use, is lightweight, and consistently pitches the ball in the strike zone of the batter without the necessity of laborious resetting the apparatus every time the operator wishes to change the type of pitch generated by the apparatus.

Accordingly, it is an object of this invention to provide a ball throwing apparatus for randomly pitching a variety of balls such as a left-hand curve, right-hand curve, slider, fast ball or the like and can be consistently pitched into the strike zone of the batter without the need for laborious readjustment every time a different type of pitch is desired, once the barrel of the apparatus is initially adjusted for distance.

A further object of this invention is to provide a means for randomly varying the type of pitches thrown by the machine, for duplicating the actual playing conditions in a baseball game where the pitcher randomly throws different types of pitches depending on what he deems will work best against a particular batter. This ability to quickly change the type of pitch thrown without resetting the machine, duplicate actual playing conditions and is an aid in training the ball player.

Still, a further object of this invention is to provide a pitching barrel which can be rotated 360° about its axis, on a mounting providing for a wide variety of pitches thrown and yet still able to deliver the pitched ball into the strike zone of the batter without the necessity of recalibrating the apparatus each time a different type of pitch is thrown.

Still, a further object of this invention is to provide an apparatus which can be adjusted to change the spin on the ball and the type of curve thrown by the machine. The pitch can be adjusted to curve in any direction through a full 360° around the axis of the projecting barrel.

Still, a further object of this invention is to provide inserts in the barrel for allowing different types of balls to be pitched such as tennis balls, ping pong balls, or the like.

Another object of this invention is to provide a ball throwing apparatus which will randomly throw a variety of pitches. This can be accomplished by randomly rotating the barrel on the barrel mount between pitches without any interruptions being required to reset the angle of the trajectory, since this apparatus can pitch the ball into the strike zone of the batter; any type of pitch thrown will still be trajected into the strike zone of the batter.

This invention has exceptional portability—effected in part by the ease in which the major sub-assembly can be separated and re-positioned, all without any tools.

DETAILED DESCRIPTION OF THE PREFERRED EMBODIMENT

Figure 5:
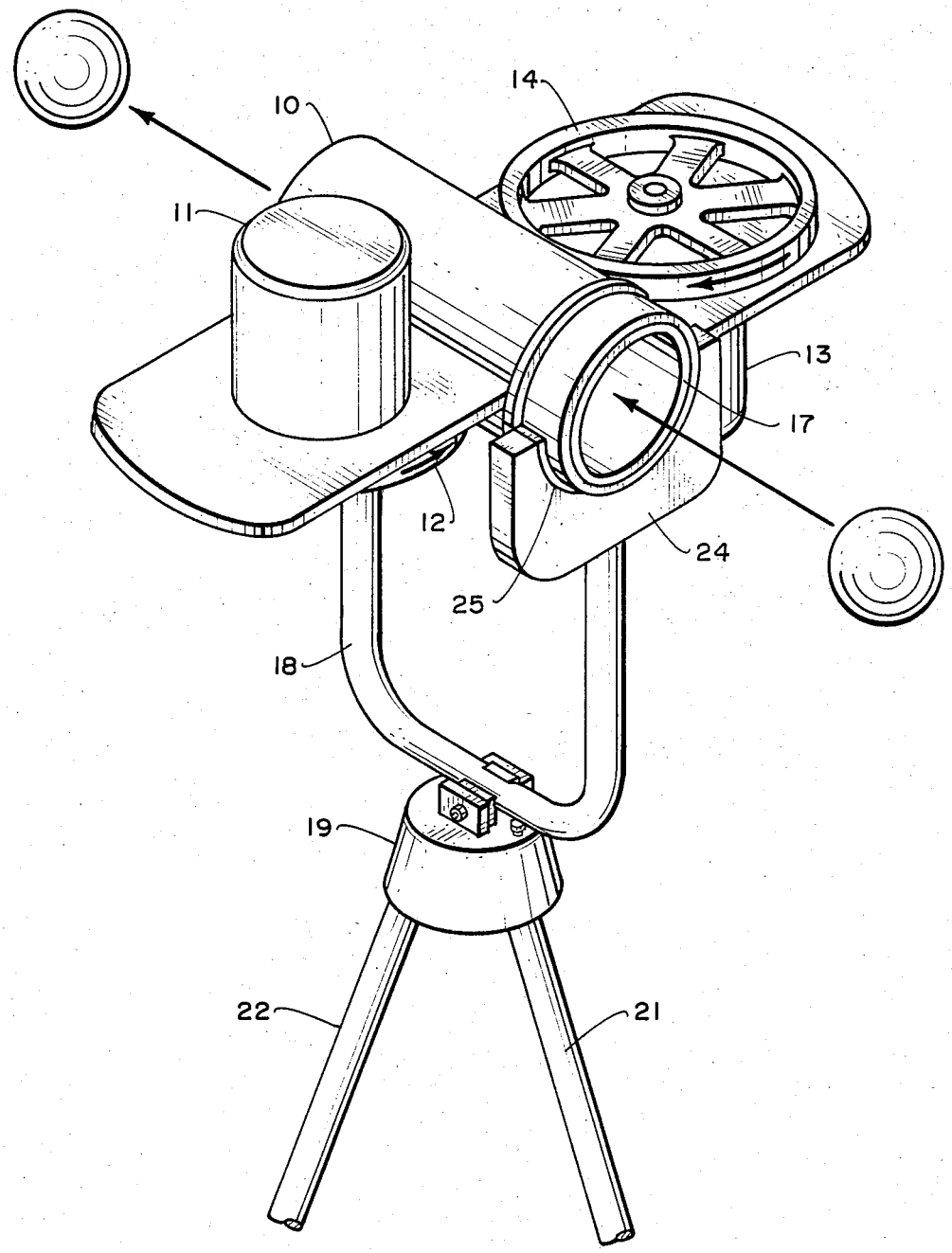
FIG. 5 is a perspective view of the ball pitching device indicating how the ball is fed into and ejected from the apparatus.

Referring now to the drawings, FIG. 5 discloses a perspective view of the ball throwing apparatus. It is rotatively resting on the support base or standard and is generally indicated by number 2 in the drawing. The standard is further sub-divided into a mount indicated at 19 and mounting legs 20, 21, and 22. The mount 19 secures the bight portion of a U shaped yoke support 18 which has mounted at both ends upright crutches. The rear crutch is indicated as number 24. The front crutch 15 is disclosed in the other figures.

Figure 4:
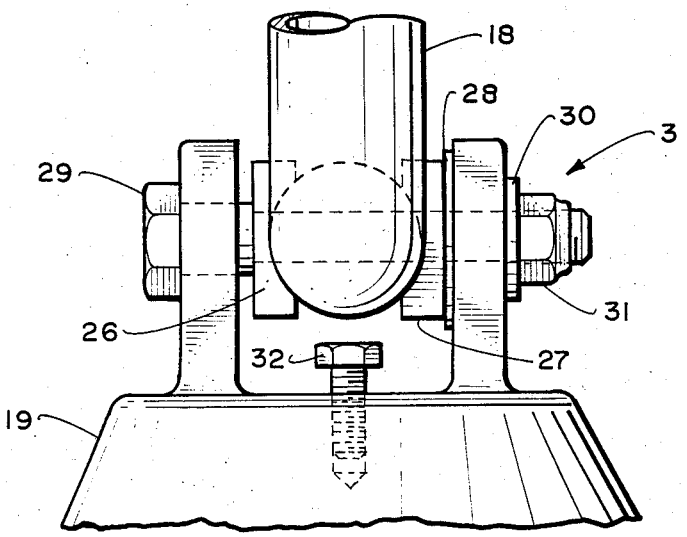
FIG. 4 is an enlarged view of the joint (circled at 4 in FIG. 1) between the yoke and the tripod mount as indicated in FIG. 1.

FIG. 4 is an enlarged view of the connection generally designated as 3, wherein the U shaped yoke 18 is attached to the mount 19. FIG. 4 will be described in greater detail in a later paragraph. For the moment, however, the purpose of this type of mount is to allow the yoke 18 to be adjusted by tilting the yoke rearward or forward to increase the trajectory of the ball to shoot it a greater distance or to tilt the U shaped yoke forward to decrease the toss of the ball. This connection is adjustable to permit the angular adjustment of the yoke 18 about the horizontal axis perpendicular to the plane of the yoke 18. This adjusts the elevation of the pitch.

The crutches 24 and 15 (FIGS. 1 and 5) allow for support and resting of a barrel means 10 having a feed end and a delivery end for guiding and aiming the balls which are projected from the barrel 10. The distance between the two crutches 15 and 24 is less than the length of the barrel 10. The rounded cut-outs 41 and 42 removed from each crutch 24 and 15, are of a generally semi-circular shape which mates with the circumference of the barrel 10. That is, the semi-circular shape of each cut-out matches the circumference of the barrel 10. Attached to each crutch cut-out 41 and 42, is a friction pad indicated at 25 and 16, respectively, which creates a drag on the rotatability of the barrel 10. The pad creates enough friction so that the barrel 10 can be rotated manually, but will stay in any angular position the operator of the machine wishes to leave it in. There is a thrust ring 23 which encircles the rear of the barrel 10 inward from the crutch 24. The purpose of this thrust ring 23 is to stop the recoil which may result when the ball 4 is ejected out of the delivery or muzzle end of the barrel 10. The barrel 10 has a frame 6 which has generally wing-like extensions extending from both sides of the barrel 10. In one side of the frame 6 is attached a first drive wheel means described as the first drive wheel 12 and the first motor 11. On the opposite side of the first wheel 12 is the second drive means described as the second drive wheel 14 and the second motor 13. The second drive wheel 14 rotates in a direction towards the delivery end of the barrel 10. Likewise, the first drive wheel 12 also rotates in the direction towards the muzzle of the barrel 10. Because they rotate towards the delivery end of the barrel 10, each wheel 14, 12 rotates in the opposite direction compared with the other. The second drive wheel 14 is offset longitudinally of the longitudinal axis of the barrel with respect to the drive wheel 12. The second drive wheel 14 is positioned rearward towards the barrel insert end and the first drive wheel 12 is positioned towards the barrel delivery end. The second drive wheel 14 has a faster peripheral speed than the first drive wheel 12. The importance of this speed differential will be discussed more fully when the other views are discussed. The ball 4 when being fed into the feed end of the barrel 10 is somewhat sucked in as a result of the venturi effect from the two drive wheels spinning toward the delivery end of the barrel 10. As the ball passes through the barrel, it is frictionally engaged and accelerated first by the second wheel 14 and secondly by the first drive wheel 12. This causes the ball to spin on its axis. The ball will generally always have this type of a spin and trajectory beginning regardless wherever the frame 6 is positioned and the barrel 10 is generally rotated. A barrel insert 17 allows for the feeding of various diameter balls into the barrel and can also act as a chute to allow a ball to be properly fed into the nip between the first drive wheel 12 and the second drive wheel 14.

Figure 2:
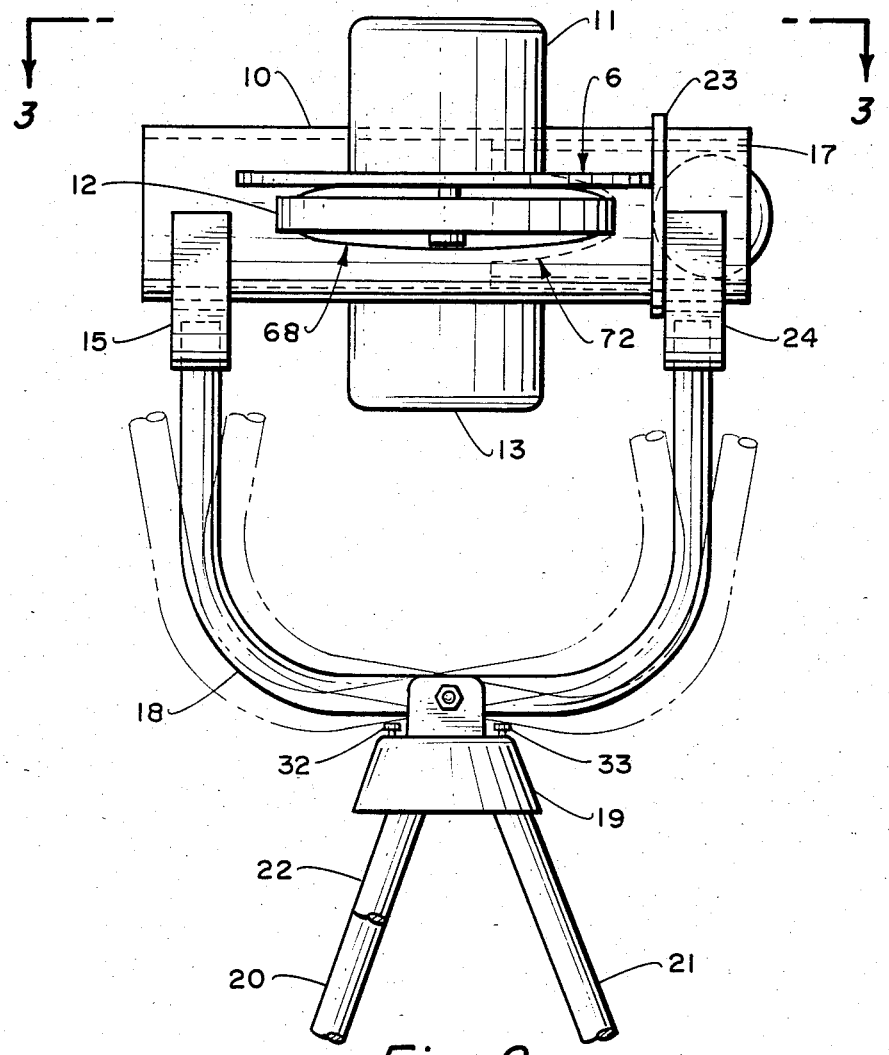
FIG. 2 shows a side elevational view taken on line 2—2 in FIG. 1, indicating that the elevation angle of the ball leaving the barrel can be adjusted by tilting back or forth the yoke upon the tripod and mount. The ball is fed into the barrel from the right and exits out the left delivery end.
Figure 3:
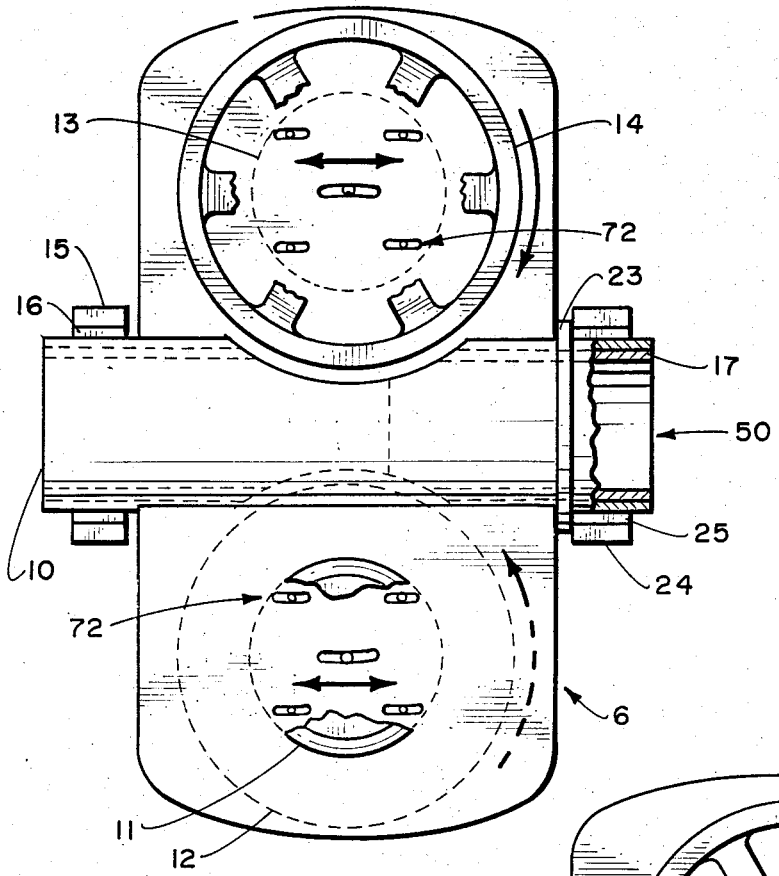
FIG. 3 is a top plan view taken on line 3—3 in FIG. 2 of the apparatus indicating that the ball is fed into the right end and is ejected out the left hand side of the barrel. There are slots showing that both of the drive wheels can be adjusted independently by slideable movement longitudinally adjacent to the axis of the barrel.
Figure 3A:
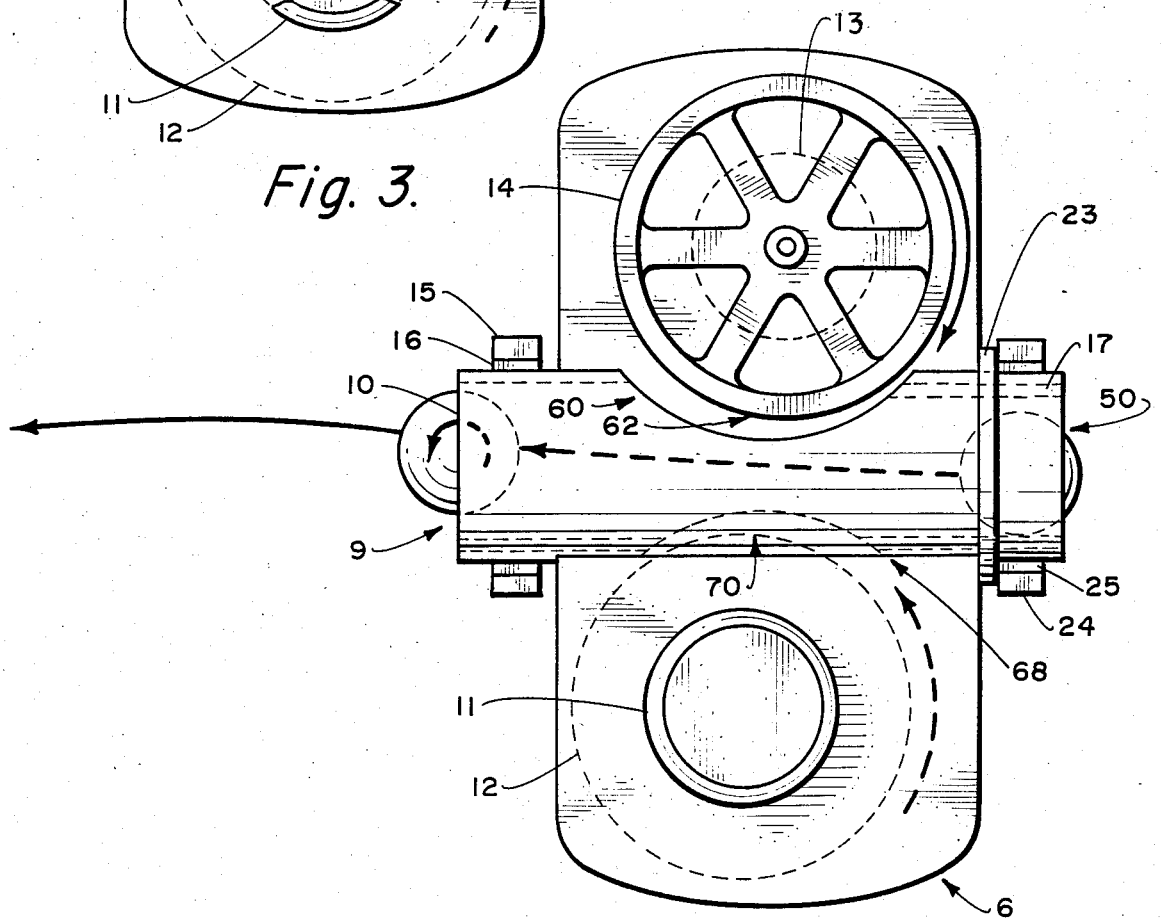
FIG. 3A is a modified view of FIG. 3, showing the offset positioning of the drive wheels. The path of the ball is indicated by the arrowed line. The ball is inserted into the feed end of the barrel, and as it passes between the two drive wheels, the ball is deflected to the right because of the spacing of the drive wheels and the differential speed of the drive wheels. In this particular example, the ball has been imparted a counter clockwise rotation which will result in a horizontally curved ball.

FIG. 3A is taken along the lines C—C, FIG. 2. There is shown in FIG. 3A the top plan view showing generally the first wheel means 11/12, second wheel means 13/14, barrel means 10 which includes the barrel insert 17 and thrust washer 23. The frame means is generally indicated by number 6. This frame means is attached to the barrel means 10 and further houses the first wheel means 12 and second wheel means 14. FIG. 3 is similar to FIG. 3A, with the added disclosure that the first wheel means 12 and the second wheel means 14 can be slideably mounted on the frame 6 in a direction longitudinal with respect to the longitudinal axis of the barrel 10.

In FIG. 3A, the second drive wheel 14 is shown in its most rearward slideable positon. It is contemplated that the first drive wheel 12 and the second drive wheel 14 could be directly opposed in the barrel 10 and having no offset relative to which wheel is closer to the delivery end 9 of the barrel 10.

FIG. 3A discloses the path the ball will travel as it is propelled the length of the barrel 10. The feed end 50 of the barrel 10 indicates where the operator of the machine initially inserts the ball 4. Since the first drive wheel 12 and second drive wheel 14 are rotating as indicated, there is a slight venturi suction created at the feed end 50 which assists in introducing the ball into the barrel 10. The barrel insert 17 has an outside diameter substantially equaling that of the inside diameter of the barrel 10. This is a replaceable and detachable insert which allows for various interior diameters in the insert for acting as a guide for balls of smaller diameter than that disclosed in FIGS. 3 and 3A. A curved slot 60 is cut away from the side of the barrel 10 for allowing the periphery 62 of the second drive wheel 14 to enter into the interior of the barrel 10. Another slot 68 is in phantom lines indicating that the slot for the first wheel 12 is also cut away from the under side of the barrel 10 for allowing the periphery 70 of the first wheel 12 to enter the interior of the barrel 10. The slot 68 is shown in phantom lines since this is a top plan view and the slot 68 is not visible from this side. The periphery 62 of the second drive wheel 14 and the periphery 70 of the first drive wheel 12 have surfaces which have somewhat of a rough surface in order to frictionally engage the ball 4 as it passes through the feed end 50 of the barrel 10 and out the delivery end 9 of the barrel 10.

In the operation, the ball is fed into the feed end 50 and it is sucked in by the venturi effect of the rotating drive wheels 14 and 12. For the purpose of illustration in figure 3A, it shall be presumed that the second wheel 14 is closer to the feed end 50 of the barrel 10. The ball is inserted and it firstly engages the periphery 62 of the second wheel 14. This causes a spin to be imparted to the ball and the ball then frictionally engages the periphery 70 of the first. drive wheel 12. As a result of the interaction of the two opposite drive wheels 12 and 14, the ball has a spin imparted to it in a counter-clockwise direction. Both peripheries 62, 70 propel the ball down the barrel. Further, it is the beginning of a trajectory of the ball which is indicated by the line showing that a curved pitch is being generated. In practice, with the frame being horizontal relative to the ground, the type of pitch which would be created in this position of the frame 6 would be considered to be a left breaking horizontal curve.

As shown in FIG. 3A, the inner diameter of the barrel 10 is appreciably greater than the diameter of the ball being propelled from the barrel. This fact, that the cross sectional area of the barrel 10 (FIG. 1) is appreciably greater than that of the ball, permits the ball to be propelled from the delivery end of the barrel on the trajectory which diverges angularly from the longitudinal axis of the barrel 10.

At the feed end, the insert 17 (FIG. 2) encompasses the ball more closely, and guides it into proper engagement with the drive wheels 12 and 14.

FIG. 3 shows the variable slots 72 for both drive means 12 and 14 to indicate that the periphery could be adjusted by the sliding movements longitudinally relative to the longitudinal axis of the barrel 10. The purpose of this adjustment ability would be to modify the spin characteristics of the ball and to alter the trajectory of the ball as it is shot out the delivery end 9 of the barrel 10. FIG. 3A also presumes that the periphery 62 is going at faster speed than the periphery 70. The speed differential can be accomplished by either a different shaft rotational velocity or by having a larger diameter second wheel 14 compared to the first wheel 12, which would inherently give a faster peripheral. speed of 62, assuming that both drive means are rotating at the same rpm. This peripheral speed differential could also be accomplished by increasing the rpm of the drive motor 12 relative to drive motor 11 or alternatively decreasing the rpm of the drive motor 11 compared to the rpm of the second drive motor 13. The slots 72 are slightly arcuate in order to maintain a substantially constant nip between the two wheels 12 and 14, as the drivers are adjusted.

FIG. 2 is a side elevaticnal view showing the barrel 10 in a horizontal position relative to the ground. FIG. 2 shows that the yoke 18 can be tilted forward or backward. The tilting of the yoke alters the distance and the trajectory path that the ball travels after it leaves the delivery end 9 of the barrel 10. There are disclosed adjustment stops 32 and 33 at the top of the mount 19 which can be adjusted to keep the yoke 18 in one particular tilted positon but they are adjustable to permit angular adjustment of the yoke 18 about a horizontal axis perpendicular to the plane of the yoke. In other word, the yoke can be tilted, forward or backward. There is shown in FIG. 2 the front crutch 15 and the rear crutch 24 which are attached to the yoke 18 in an upright position. The barrel means 10 is shown resting on these respective crutches. There is shown the barrel slot 68 where the first drive wheel 12 enters the interior of the barrel 10. The one edge of the frame 6 is also disclosed. The barrel insert 17 further shows that there is a cutaway portion 72 to also allow for part of the periphery of the various drive wheels to turn freely.

Figure 1:
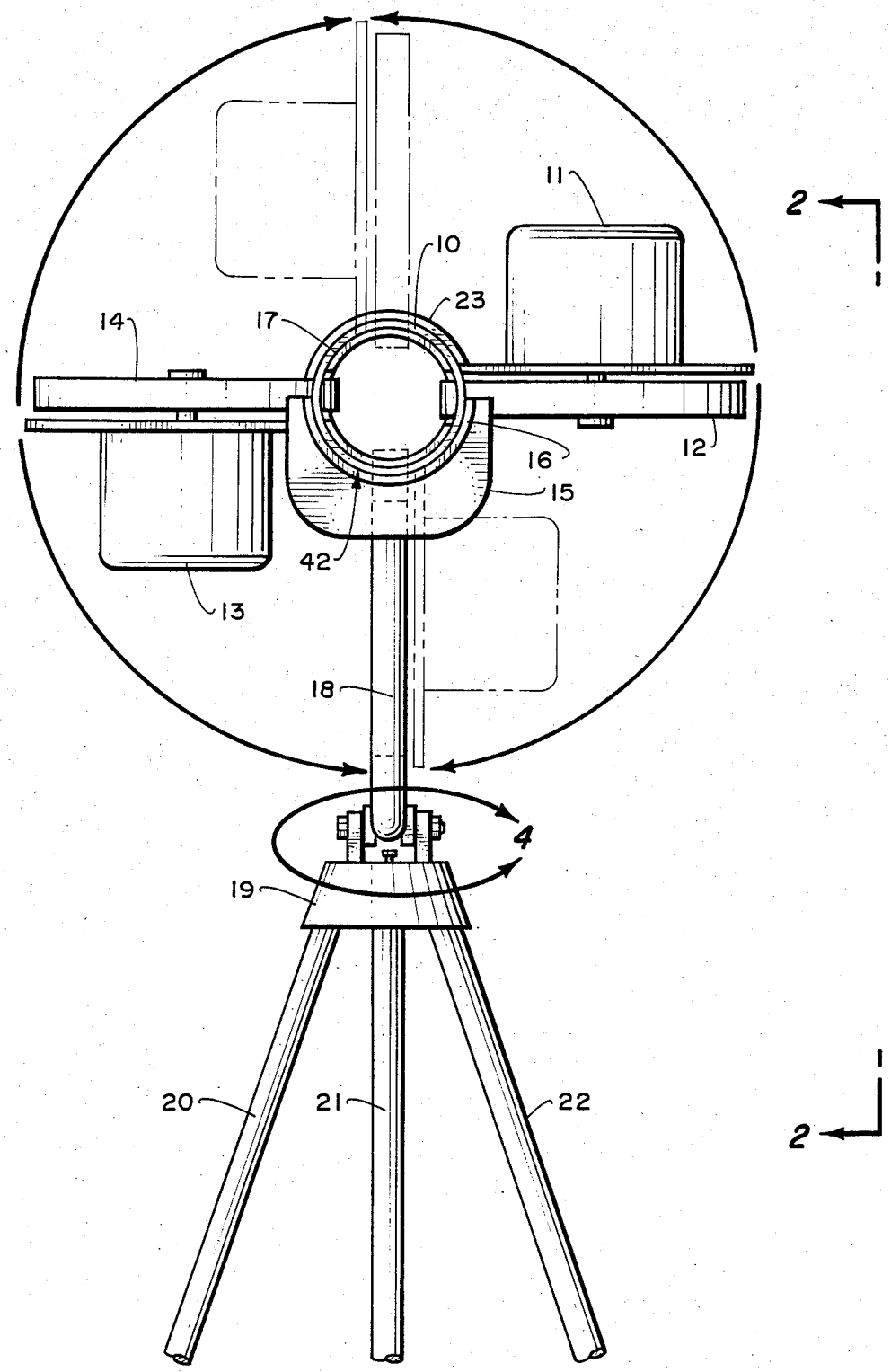
FIG. 1 shows a front elevational view of the ball pitching machine mounted on a tripod and having a barrel resting on a crutch. The arrowed and hatched circular line indicates that the barrel is infinitely rotatable on the crutch. This allows the ball to be pitched in a particular manner, responsive to the angular position of the barrel and drive wheels.

Now referring to FIG. 1, which is a front elevational view of the ball throwing apparatus, the front upright crutch 15 is disclosed with the semi-circular pad or cutaway 42. The friction pad at 16 is also disclosed. In the solid lines there is indicated that the first drive wheel 12 is in the horizontal plane and the second drive wheel is at 14. In this configuration the ball when ejected, will make a left horizontal curve. In the hatched lines, indicating a vertical orientation of the frame 6, the ball will still interact first with the periphery 62 of the second wheel 14 and then with the periphery 70 of the first drive wheel 12. The vertical orientation is accomplished by rotating the frame 6 90° so that the drive wheel 12 is in the upper vertical array, drive wheel 14 is in the lower vertical position. In this orientation, the ball will come out with a reverse spin and would be like a speed ball having a slight angular rise relative to the ground. As the frame 6 is rotated counter clockwise 90° again, so that the drive wheel number 12 is in the left horizontal array and the drive wheel 14 is in the right horizontal array, one will have the same characteristics as if the drive wheel 14 was in the left horizontal array and the drive wheel 12 was in the right horizontal array, the difference being that the ball will throw a horizontal right curve ball. Rotating the frame 6, counter-clockwise 90°, so that again the drive wheel 12 is in the lower vertical array and the drive wheel 14 in the upper vertical array will produce a ball with overspin thus creating a slider or dropping ball relative to the batter. All of these rotational configurations of the frame 6 are for the purposes of imparting a particular spin and trajectory on the thrown ball. Regardless of where the angular rotation of the frame 6 is inclined, the ball will still penetrate the same general strike zone when the batter is standing over a fixed home plate. The ease of this invention is that one simply sets up the standard 2 by screwing on the tripod legs 20, 21, and 22 into tripod 19, placing the tripod erect with the yoke 18 preattached, and then placing the barrel means 10 onto the crutches of the yoke; and then tilting the yoke to find the proper distance to hit the desired strike zone. After the proper tilt of the yoke has been established by adjustment, it may be tightened so that this adjustment will not vary. The tripod leg 21 is in alignment with the trajectory of the ball so that any recoil as a result of the ball being shot out will be absorbed by this particular tripod leg. Furthermore the positioning of the drive means 12 and 14 in spatial relation to the axis of the barrel 10, creates a center of gravity at the center of the barrel 10 and generally the center of the gravity is toward the tripod head 19. The detachable feature of the barrel 10 and of the various components of the apparatus allows it to be rapidly erected, mounted, adjusted for the distance to the home plate and strike area and the machine is then ready for use. The barrel means 10 can be rotated on its respective crutches 42 and 24 to any angle it chooses from 0° through 360° thus allowing an infinite variety of pitch, each of which will still be within the strike zone of the batter. The balancing of the components and the rearward tripod leg 21 prevents the machine from "stepping" when its on a hard surface such as a gym floor and accordingly this avoids the problem of realigning the flight path of the ball frequently.

FIG. 4 shows a close-up view of an attachment means designated as 3. There is a bolt 29 between the two mounts holding the yoke 18. The clamping blocks 26 and 27 secure the yoke 18 firmly. The friction washers 28 and 30 keep the yoke in its proper attitude or tilt after it has been adjusted. Nut 31 is a tightening feature.

Screw 32 and 33 are adjustable limit stops for limiting the tilting or rocking of the yoke 18, in setting the desired elevation of the pitch.

Whereas the present invention has been shown and described herein in what is conceived to be the best mode contemplate, it is recognized that departures may be made therefrom within the scope of the invention which is therefore not to be limited to the details disclosed herein but is to be afforded the full scope of the invention.

What is claimed is:

1. Ball throwing apparatus comprising:

a standard;

barrel means having a feed end and a delivery end for aiming a ball;

means for rotatably mounting said barrel means on said standard for rotatable adjustment about the longitudinal axis of said barrel means;

means for propelling the ball comprising:

first and second drive wheels rotatably mounted on opposite sides of said barrel means, positioned substantially in a common plane substantially coincident with the longitudinal axis of said barrel means, and having respective peripheries for frictionally engaging a ball fed into said feed end;

drive means for rotating said wheels for propelling the ball out of said delivery end;

means for mounting said first wheel farther from said feed end than said second wheel, whereby the ball is ejected from said barrel means on a path diverging angularly from said longitudinal axis of said barrel means.

2. Apparatus in accordance with claim 1, wherein:

said drive means comprises a respective pair of motors, one for each wheel, having output shafts to which the respective wheels are mounted;

said shafts being substantially parallel and lying generally in a plane offset slightly from a perpendicular to the said longitudinal axis of said barrel means.

3. Apparatus in accordance with claim 1 wherein:

said barrel means at its delivery end has a cross sectional area appreciably greater than that of the ball which is to be propelled from said barrel means.

4. Apparatus in accordance with claim 1, including:

a barrel insert positioned within the feed end of said barrel means, for guiding a ball into engagement with said wheels.

5. Ball throwing apparatus comprising;

barrel means having a feed end and a delivery end for aiming a ball;

first drive wheel means having a wheel, the periphery thereof positioned to frictionally engage a ball fed into said barrel means;

second drive wheel means having a wheel, the periphery thereof positioned to frictionally engage a ball fed into said barrel means, said barrel means extending between both said drive wheel means;

said wheel of said second drive wheel means offset with respect to said wheel of said first drive wheel means along the longitudinal axis between said feed end and said delivery end of said barrel means;

the peripheral speed of said wheel of said second drive wheel means being greater than that of said wheel of said first drive wheel means;

said wheel of said second drive wheel means being spaced rearwardly of said first wheel means with respect to the delivery end of said barrel means;

said first and said second drive wheel means having arcuate slot means for adjusting their positions with respect to each other, along the longitudinal axis between said feed end and said delivery end of said barrel means;

6. Apparatus in accordance with claim 5 including:

a standard having crutch means for demountably holding said barrel means;

said barrel means being seated in said crutch means and rotatable therein about the longitudinal axis between said feed end and said delivery end of said barrel means.

7. Apparatus in accordance with claim 6 wherein:

said standard includes a U-shaped yoke, at the upper ends of which are mounted said respective crutches, which receive said barrel means.

8. Apparatus in accordance with claim 5 including:

frame means projecting outwardly of said barrel means on opposite sides thereof for housing said first and second wheels of said first and second drive wheel means;

said first and second drive wheel means each including a motor having an output shaft oriented with its longitudinal axis transverse to the longitudinal axis between said feed end and said delivery end of said barrel means, and said drive wheel mounted on said shaft, having its periphery positioned to engage a ball in said barrel means.

9. Ball throwing apparatus comprising;

barrel means having a feed end and a delivery end for aiming a ball;

first drive wheel means having a wheel, the periphery thereof positioned to frictionally engage a ball fed into said barrel means;

second drive wheel means having a wheel, the periphery thereof positioned to frictionally engage a ball fed into said barrel means, said barrel means extending between both said drive wheel means;

said wheel of said second drive wheel means being offset with respect to said wheel of said first drive wheel means along the longitudinal axis between said feed end and said delivery end of said barrel means;

a standard having a crutch means for demountably holding said barrel means;

said barrel means being seated in said crutch means and rotatable therein about the longitudinal axis between said feed end and said delivery end of said barrel means;

said standard including: a U-shaped yoke, at the upper ends of which are mounted said respective crutch means, which receive said barrel means; and mounting legs, at the upper end of which said yoke is mounted.

10. Apparatus in accordance with claim 9 including:

mounting means between said yoke and said legs for permitting adjustable angular adjustment of said yoke about a horizontal axis perpendicular to the plane of said yoke.

11. Ball throwing apparatus comprising;

barrel means having a feed end and a delivery end for aiming a ball;

first drive wheel having a wheel, the periphery thereof positioned to frictionally engage a ball fed into said barrel means;

second drive wheel means having a wheel, the periphery thereof positioned to frictionally engage a ball fed into said barrel means, said barrel means extending between both said drive wheel means;

said wheel of said second drive wheel means being offset with respect to said wheel of said first drive wheel means along the longitudinal axis between said feed end and said delivery end of said barrel means;

frame means projecting outwardingly of said barrel means on opposite sides thereof for housing said first and second wheels of said first and second drive wheel means;

said first and second drive wheel means each including a motor having an output shaft oriented with its longitudinal axis transverse to the longitudinal axis between said feed end and said delivery end of said barrel means, and each said drive wheel being mounted on said shaft, and having its periphery positioned to engage a ball in said barrel means;

means for adjustably mounted each said first and second drive wheel means on said frame means, for adjustment with respect to the longitudinal axis of said barrel means.

12. Ball throwing apparatus comprising:

elongate barrel means having a feed end and a delivery end for aiming a substantially spherical ball;

means for propelling the ball comprising:

first and second drive wheels rotatably mounted on opposite sides of said barrel means, and having respective peripheries for frictionally engaging a ball fed into said feed end;

drive means for rotating said wheels for propelling the ball from said delivery end;

the peripheral speed of said second wheel being greater than that of said first wheel, whereby a spin is imparted to the ball;

means for mounting said first wheel farther from said feed end than said second wheel, whereby ball is ejected from said barrel means on a path diverging angularly from said longitudinal axis of said barrel means;

the spin of the ball, coupled with the diverging ejection path, serving to cause the ball to first diverge from, and then converge and cross, the said longitudinal axis of said barrel means at a selected point distant from the apparatus.

13. Apparatus in accordance with claim 12 wherein said barrel means is mounted for rotatable adjustment about said longitudinal axis.

14. Apparatus in accordance with claim 13 wherein the mounting for said barrel comprises a pair of generally U-shaped crutches lying generally in parallel planes spaced along an axis;

said barrel being cradled in said crutches;

said drive wheels being located between said crutches;

said barrel means being rotatably adjustable in said crutches about said axis.

15. Ball throwing apparatus comprising:

a base;

a U-shaped yoke having its bight portion mounted at the upper portion of said base, with the arms of the U extending upwardly from said base;

a pair of generally shaped U-shaped crutches lying substantially in parallel planes transverse to and spaced along a mounting axis, one each mounted to the respective upper ends of said arms;

a barrel, the longitudinal axis of which lies substantially on said mounting axis, cradled in and between said crutches and having ball-propelling means located between said crutches for propelling a ball from the barrel;

said barrel being rotatably adjustable in said crutches about said axis; and being cradled in said crutches free of other restraints, whereby said barrel may be freely lifted out of said crutches; and means for propelling a ball from said barrel.

16. Apparatus in accordance with claim 15 wherein said crutches are generally semi cylindrical; and have a common axis substantially coincident with said mounting axis.

17. Apparatus in accordance with claim 15 wherein said crutches are lined internally with a friction inducing lining for holding said barrel frictionally in any rotative position of said barrel.

18. Apparatus in accordance with claim 15 wherein said base comprises a plurality of legs converging and secured together at their upper ends, and to said bight position;

said barrel being positioned substantially directly above the said upper ends of said legs.

* * * * *